US010359717B2

(12) United States Patent
Takano et al.

(10) Patent No.: US 10,359,717 B2
(45) Date of Patent: Jul. 23, 2019

(54) IMAGE FORMING APPARATUS AND CORRECTION OF SPEED FLUCTUATION OF A SHEET MEMBER THROUGH THE IMAGE FORMATTING APPARATUS

(71) Applicant: Konica Minolta, Inc., Chiyoda-ku, Tokyo (JP)

(72) Inventors: Masahito Takano, Koganei (JP); Jun Onishi, Hino (JP); Takashi Fujiwara, Suginami-ku Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/916,810

(22) Filed: Mar. 9, 2018

(65) Prior Publication Data

US 2018/0259883 A1 Sep. 13, 2018

(30) Foreign Application Priority Data

Mar. 13, 2017 (JP) ..... 2017-047558

(51) Int. Cl.
*G03G 15/00* (2006.01)
*G03G 15/16* (2006.01)

(52) U.S. Cl.
CPC ..... *G03G 15/16* (2013.01); *G03G 15/1615* (2013.01); *G03G 15/50* (2013.01); *G03G 15/5008* (2013.01); *G03G 15/5025* (2013.01)

(58) Field of Classification Search
USPC .. 399/38, 42, 45, 66, 75, 76, 138, 159, 162, 399/167, 165
See application file for complete search history.

(56) References Cited

U.S. PATENT DOCUMENTS 5,444,525 A * 8/1995 Takahashi ..... G03G 15/326 399/76
7,327,972 B2 * 2/2008 Matsuda ..... G03G 15/0131 399/162

FOREIGN PATENT DOCUMENTS

JP 2009015287 A 1/2009

* cited by examiner

*Primary Examiner* — Hoan H Tran
(74) *Attorney, Agent, or Firm* — Cantor Colburn LLP

(57) ABSTRACT

An image forming apparatus includes: a photosensitive drum; a driving roller that drives a transfer member; a facing roller facing the driving roller; a driver that drives one of the photosensitive drum, the driving roller, and the facing roller; and a hardware processor that: acquires carry-in fluctuation information of speed fluctuation of any one of the photosensitive drum, the driving roller, and the facing roller when a sheet member is carried into the transfer member; detects carry-in fluctuation timing of the speed fluctuation of any one of the photosensitive drum, the driving roller, and the facing roller that occurs when the sheet member is carried into the transfer member; predicts carry-out fluctuation timing of speed fluctuation of any one of the photosensitive drum, the driving roller, and the facing roller that occurs when the sheet member is carried from the transfer member; and performs feedforward control on the driver.

10 Claims, 8 Drawing Sheets

IMAGE FORMING APPARATUS AND CORRECTION OF SPEED FLUCTUATION OF A SHEET MEMBER THROUGH THE IMAGE FORMATTING APPARATUS

CROSS REFERENCE TO RELATED APPLICATION

The present application claims priority under 35 U.S.C. § 119 to Japanese Application No. 2017-047558 filed Mar. 13, 2017, the entire content of which is incorporated herein by reference in its entirety.

BACKGROUND

Technological Field

The present disclosure relates to an image forming apparatus.

Description of the Related Art

Generally, an image forming apparatus (printer, copying machine, facsimile, etc.) utilizing an electrophotographic process technique irradiates (exposes) a charged photoconductor with (to) laser light that is based on image data, thereby forming an electrostatic latent image. Then, toner is supplied from a developing device to the photoconductor on which the electrostatic latent image has been formed, whereby the electrostatic latent image is visualized to form a toner image. Further, the toner image is directly or indirectly transferred onto a sheet, and thereafter heated, pressurized, and fixed at a fixing nip, whereby the toner image is formed on the sheet.

Conventionally, this type of image forming apparatus sometimes causes linear density unevenness called shock jitter in the case of using relatively thick cardboard as the sheet. The density unevenness is caused in the following manner: when a sheet of cardboard enters a transfer position at which an image carrier (for example, intermediate transfer belt) that rotates while carrying a toner image is in contact with a transfer belt (for example, secondary transfer roller) that rotates in contact with the image carrier and transfers the toner image formed on the surface of the image carrier onto the sheet, the load on the drive source of the image carrier rapidly increases, and the surface moving speed of the image carrier instantaneously drops to a great extent.

In this respect, JP 2009-15287 A discloses bringing a sheet into contact with a predetermined position on an endless belt, detecting the contact based on the speed fluctuation, and predicting the timing at which the sheet arrives at a nip from the contact position. JP 2009-15287 A further discloses a method of performing feedforward control to suppress the speed fluctuation that occurs when the sheet is carried into the nip.

In the above method, it is necessary to execute the feedforward control in an extremely short period of time from the detection of the contact to the arrival of the sheet at the nip, which is a problem in terms of improving density unevenness.

SUMMARY

The present disclosure is directed to solving the above-described problem, and an object thereof is to provide an image forming apparatus capable of effectively improving density unevenness.

To achieve the abovementioned object, according to an aspect of the present invention, an image forming apparatus reflecting one aspect of the present invention comprises: a photosensitive drum; a driving roller that drives a transfer member for transferring an image carried by the photosensitive drum; a facing roller facing the driving roller; a driver that drives at least one of the photosensitive drum, the driving roller, and the facing roller; and a hardware processor that: acquires carry-in fluctuation information of speed fluctuation of at least any one of the photosensitive drum, the driving roller, and the facing roller when a sheet member is carried into the transfer member; based on the carry-in fluctuation information acquired, detects carry-in fluctuation timing of the speed fluctuation of at least any one of the photosensitive drum, the driving roller, and the facing roller that occurs when the sheet member is carried into the transfer member; based on the carry-in fluctuation timing detected, predicts carry-out fluctuation timing of speed fluctuation of at least any one of the photosensitive drum, the driving roller, and the facing roller that occurs when the sheet member is carried from the transfer member; and based on the carry-out fluctuation timing predicted, performs feedforward control on the driver to correct the speed fluctuation that occurs when the sheet member is carried from the transfer member.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
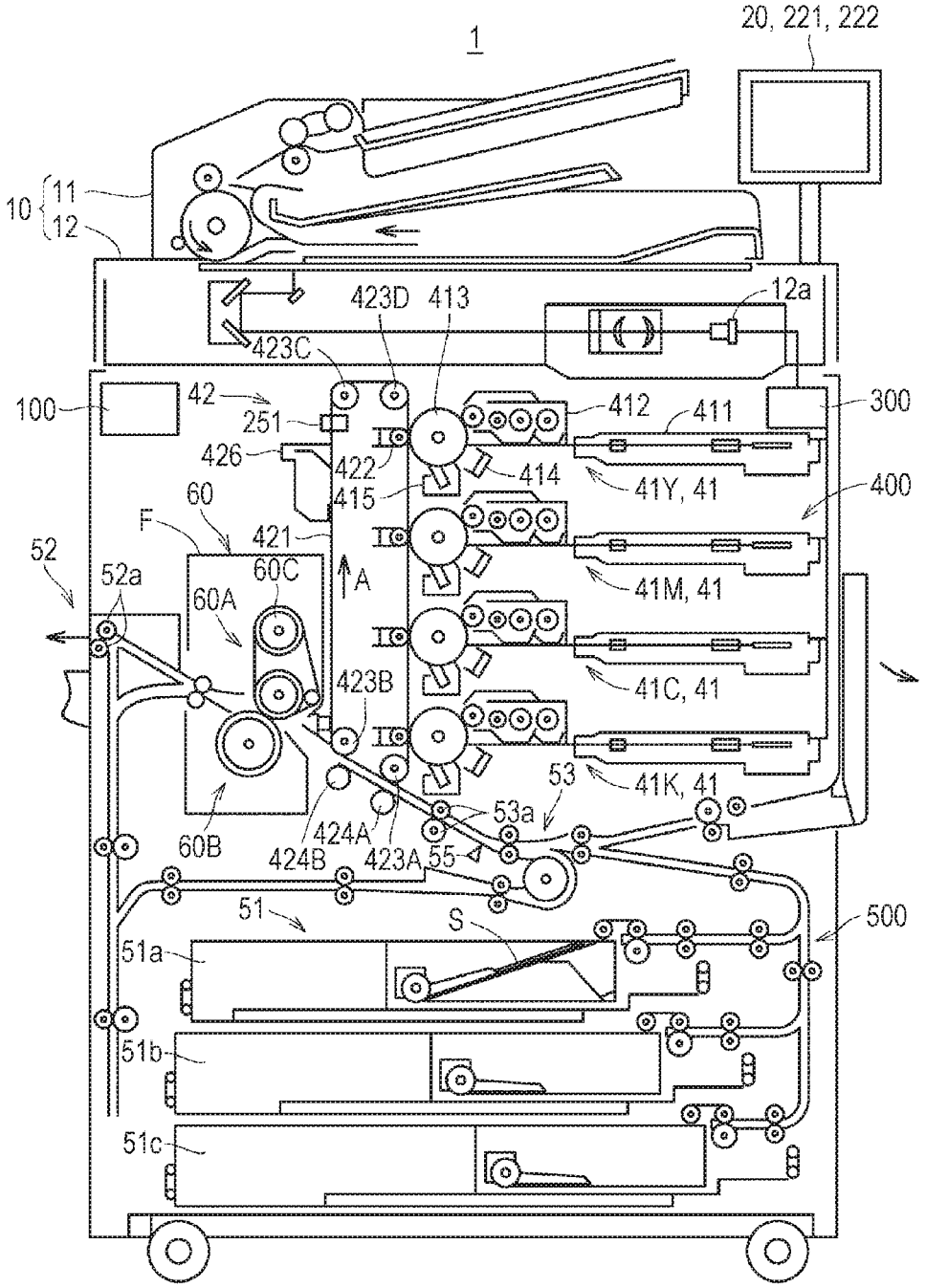
FIG. 1 is a view schematically illustrating the overall configuration of an image forming apparatus according to an embodiment.

Hereinafter, one or more embodiments of the present invention will be described in detail with reference to the drawings. However, the scope of the invention is not limited to the disclosed embodiments. In the drawings, the same or corresponding parts are denoted by the same reference signs, and the description thereof is not repeated.

FIG. 1 is a view schematically illustrating the overall configuration of an image forming apparatus 1 according to an embodiment.

Figure 2:
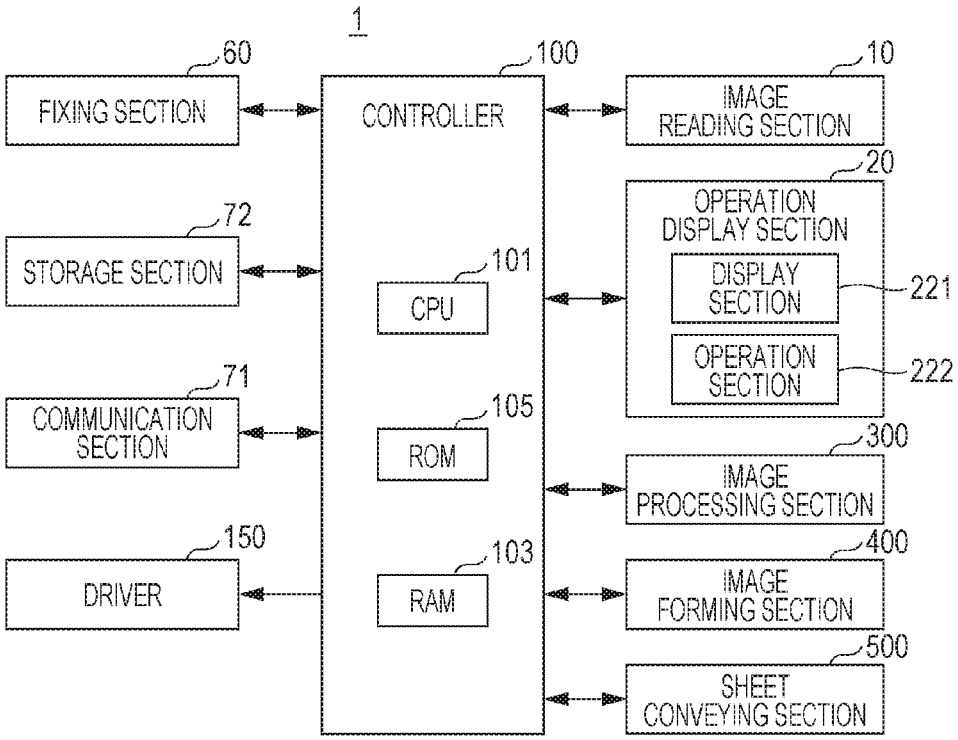
FIG. 2 is a diagram for explaining the main part of a control system of the image forming apparatus according to an embodiment.

FIG. 2 is a diagram for explaining the main part of a control system of the image forming apparatus 1 according to an embodiment.

As illustrated in FIG. 1 and FIG. 2, the image forming apparatus 1 is an intermediate transfer color image forming apparatus utilizing an electrophotographic process technique. That is, the image forming apparatus 1 transfers toner images of respective colors of yellow (Y), magenta (M), cyan (C), and black (K) formed on photosensitive drums 413 onto an intermediate transfer belt 421 (primary transfer), superimposes the toner images of the four colors on the intermediate transfer belt 421, and then transfers the toner images onto a sheet S (secondary transfer), thereby forming an image.

The image forming apparatus 1 adopts a tandem system in which the photosensitive drums 413 corresponding to the four colors of Y, M, C, and K are disposed in series in the travel direction of the intermediate transfer belt 421, and the toner images of the respective colors are sequentially transferred onto the intermediate transfer belt 421 in a single procedure.

As illustrated in FIG. 2, the image forming apparatus 1 includes an image reading section 10, an operation display section 20, an image processing section 300, an image forming section 400, a sheet conveying section 500, a fixing section 60, and a controller 100.

The controller 100 includes a central processing unit (CPU) 101, a read only memory (ROM) 102, a random access memory (RAM) 103, and the like. The CPU 101 reads a program corresponding to the processing content from the ROM 105, develops it in the RAM 103, and cooperates with the developed program to centrally control the operation of each block of the image forming apparatus 1. At this time, various data stored in a storage section 72 are referred to. The storage section 72 includes, for example, a nonvolatile semiconductor memory (what is called a flash memory) or a hard disk drive.

The controller 100 transmits/receives, via a communication section 71, various data to/from an external device (for example, personal computer) connected to a communication network such as a local area network (LAN) and a wide area network (WAN). For example, the controller 100 receives image data transmitted from the external device so that an image is formed on the sheet S based on the image data (input image data). The communication section 71 includes, for example, a communication control card such as a LAN card.

The controller 100 controls a driver 150 that drives a driving roller, which will be described later. In accordance with an instruction from the controller 100, the driver 150 adjusts, for example, the speed of the driving roller of the intermediate transfer belt 421. It should be noted that the driver 150 can adjust the speed by driving at least one of a driving motor that drives the photosensitive drum 413 and a secondary transfer roller, instead of driving the driving roller of the intermediate transfer belt 421.

The image reading section 10 includes an automatic document feeding device 11 which is called an automatic document feeder (ADF), a document image scanning device 12 (scanner), and the like.

The automatic document feeding device 11 conveys a document D placed on a document tray by a conveying mechanism and sends it to the document image scanning device 12. It is possible for the automatic document feeding device 11 to continuously read images (including both sides) of a large number of documents D placed on the document tray at once.

The document image scanning device 12 optically scans a document conveyed onto the contact glass from the automatic document feeding device 11 or a document placed on the contact glass, forms an image of reflected light from the document on a light receiving surface of a charge coupled device (CCD) sensor, and reads the document image. The image reading section 10 generates input image data based on a reading result provided by the document image scanning device 12. The input image data are subjected to a predetermined image process in the image processing section 300.

The operation display section 20 includes, for example, a liquid crystal display (LCD) with a touch panel, and functions as a display section 221 and an operation section 222. The display section 221 displays various operation screens, the state of images, the operating condition of each function, and the like according to display control signals input from the controller 100. The operation section 222 includes various operation keys such as a numeric keypad and a start key, accepts various input operations by a user, and outputs operation signals to the controller 100.

The image processing section 300 includes a circuit or the like for performing a digital image process on the input image data according to initial setting or user setting. For example, under the control of the controller 100, the image processing section 300 performs gradation correction based on gradation correction data (gradation correction table). In addition to the gradation correction, the image processing section 300 subjects the input image data to various correction processes such as color correction and shading correction, a compression process, and the like. The image forming section 400 is controlled based on the image data subjected to these processes.

The image forming section 400 includes image forming units 41Y, 41M, 41C, and 41K for forming images with the respective color toners of the Y component, M component, C component, and K component based on the input image data, an intermediate transfer unit 42, and the like.

The image forming units 41Y, 41M, 41C, and 41K for the Y component, M component, C component, and K component have similar configurations. For the convenience of illustration and explanation, common components are denoted by the same reference signs, and Y, M, C, or K is added to the reference signs when the components are distinguished from one another.

In FIG. 1, only the components of the image forming unit 41Y for the Y component are denoted by reference signs, and the reference signs of the components of the other image forming units 41M, 41C, and 41K are omitted.

The image forming unit 41 includes an exposure device 411, a developing device 412, the photosensitive drum 413, a charging device 414, a drum cleaning device 415, and the like.

The photosensitive drum 413 is a negatively charged organic photoconductor (OPC) including an undercoat layer (UCL), a charge generation layer (CGL), and a charge transport layer (CTL) sequentially laminated on a peripheral surface of a conductive cylinder made of aluminum (aluminum tube) having a drum diameter of 60 [mm], for example. The charge generation layer includes an organic semiconductor in which a charge generation material (for example, phthalocyanine pigment) is dispersed in a resin binder (for example, polycarbonate), and generates a pair of positive and negative charges upon exposure by the exposure device 411. The charge transport layer is formed by dispersing a hole transporting material (electron-donating nitrogen-containing compound) in a resin binder (for example, polycarbonate resin), and transports the positive charge generated in the charge generation layer to the surface of the charge transport layer.

The controller 100 controls a driving current that is supplied to a driving motor (not illustrated) that rotates the photosensitive drum 413, whereby the photosensitive drum 413 rotates at a predetermined peripheral speed.

The charging device 414 uniformly charges the surface of the photosensitive drum 413 having photoconductivity to negative polarity by generating corona discharge.

The exposure device 411 includes, for example, a semiconductor laser, and irradiates the photosensitive drum 413 with laser beams corresponding to the image of each color component. A positive charge is generated in the charge generation layer of the photosensitive drum 413 and transported to the surface of the charge transport layer, whereby the surface charge (negative charge) of the photosensitive drum 413 is neutralized. An electrostatic latent image of each color component is formed on the surface of the photosensitive drum 413 due to a potential difference between the surface and the surroundings.

The developing device 412 is a two-component reversal developing device and visualizes the electrostatic latent image to form a toner image by attaching the toner of each color component to the surface of the photosensitive drum 413. A developing roller 412A of the developing device 412 carries a developer while rotating and supplies the toner contained in the developer to the photosensitive drum 413, thereby forming a toner image on the surface of the photosensitive drum 413.

The drum cleaning device 415 has a drum cleaning blade or the like that is brought into sliding contact with the surface of the photosensitive drum 413 and removes the transfer residual toner remaining on the surface of the photosensitive drum 413 after primary transfer.

The intermediate transfer unit 42 includes the intermediate transfer belt 421, a primary transfer roller 422, a plurality of support rollers 423, a secondary transfer roller 424, a belt cleaning device 426, and the like.

The intermediate transfer belt 421 includes an endless belt in which polyimide (PI) is used as a base, and is looped around the plurality of support rollers 423. At least one of the plurality of support rollers 423 includes a driving roller, and the others include driven rollers. For example, the roller 423B disposed on the downstream side of the primary transfer roller 422 for the K component in the belt travel direction includes a driving roller. This makes it easier to keep the travel speed of the belt at the primary transfer portion constant. As the driving roller 423B rotates, the intermediate transfer belt 421 travels at a constant speed in the direction of an arrow A.

The intermediate transfer belt 421 is a belt having conductivity and elasticity and has a high resistance layer having a volume resistivity of 8 to 11 [log Ω·cm] on its surface. The intermediate transfer belt 421 is rotationally driven by a control signal from the controller 100 via the support rollers 423. Note that the material, thickness, and hardness of the intermediate transfer belt 421 are not limited as long as the intermediate transfer belt 421 has conductivity and elasticity.

The primary transfer roller 422 is disposed on the inner peripheral side of the intermediate transfer belt 421 so as to face the photosensitive drum 413 of each color component. A primary transfer nip for transferring a toner image from the photosensitive drum 413 onto the intermediate transfer belt 421 is formed by pressing the primary transfer roller 422 against the photosensitive drum 413 with the intermediate transfer belt 421 in between.

The secondary transfer rollers 424A and 424B are disposed on the outer peripheral side of the intermediate transfer belt 421 so as to face the roller 423A and the driving roller 423B. A secondary transfer nip for transferring a toner image from the intermediate transfer belt 421 onto the sheet S is formed by pressing the secondary transfer rollers 424A and 424B against the roller 423A and the driving roller 423B with the intermediate transfer belt 421 in between.

When the intermediate transfer belt 421 passes through the primary transfer nip, the toner images on the photosensitive drums 413 are sequentially superimposed and primarily transferred onto the intermediate transfer belt 421. Specifically, by applying a primary transfer bias to the primary transfer roller 422 and imparting a charge having the polarity opposite to that of the toner to the back side of the intermediate transfer belt 421 (side in contact with the primary transfer roller 422), the toner images are electrostatically transferred onto the intermediate transfer belt 421.

Thereafter, when the sheet S passes through the secondary transfer nip, the toner image on the intermediate transfer belt 421 is secondarily transferred onto the sheet S. Specifically, by applying a secondary transfer bias to the secondary transfer rollers 424A and 424B, and imparting a charge having the polarity opposite to that of the toner to the back side of the sheet S (side in contact with the secondary transfer rollers 424A and 424B), the toner image is electrostatically transferred onto the sheet S. The sheet S onto which the toner image has been transferred is conveyed toward the fixing section 60.

The belt cleaning device 426 removes the transfer residual toner remaining on the surface of the intermediate transfer belt 421 after secondary transfer.

The fixing section 60 includes an upper fixing section 60A having a fixing surface side member disposed on the fixing surface side of the sheet S (surface on which a toner image is formed), a lower fixing section 60B having a back side support member disposed on the back side of the sheet S (surface opposite to the fixing surface), a heating source 60C, and the like. By pressing the back side support member against the fixing surface side member, a fixing nip for holding and transporting the sheet S is formed.

In the fixing section 60, the conveyed sheet S with the secondarily-transferred toner image is heated and pressurized at the fixing nip, whereby the toner image is fixed on the sheet S. The fixing section 60 is disposed as a unit in a fixing device F. Further, an air separation unit for separating the sheet S from the fixing surface side member or the back side support member by blowing air may be disposed in the fixing device F.

The sheet conveying section 500 includes a sheet feed section 51, a sheet discharge section 52, a conveyance path section 53, and the like. In three sheet feed tray units 51*a* to 51*c* constituting the sheet feed section 51, sheets S (standard paper, special paper) identified based on basis weight, size, and the like are accommodated for each preset type. The conveyance path section 53 has a plurality of conveying roller pairs such as a registration roller pair 53*a*.

Further, a detection sensor 55 for detecting the sheet S is provided on the conveyance path section 53.

The sheets S accommodated in the sheet feed tray units 51*a* to 51*c* are sent one by one from the uppermost portion and conveyed to the image forming section 400 by the conveyance path section 53. At this time, the inclination of the fed sheet S is corrected and the conveyance timing is adjusted by the registration roller portion provided with the registration roller pair 53*a*. Then, in the image forming section 400, the toner image of the intermediate transfer belt 421 is secondarily transferred collectively onto one side of the sheet S, and the fixing process is performed in the fixing section 60. The sheet S on which the image has been formed is discharged to the outside of the apparatus by the discharge section 52 including a discharge roller 52*a*.

Figure 3:
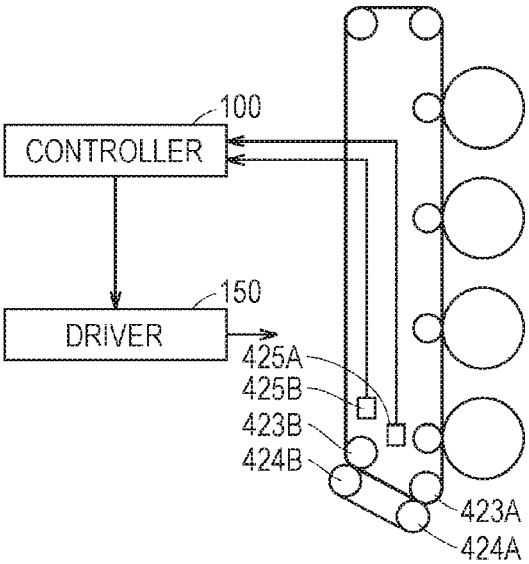
FIG. 3 is a diagram for explaining a configuration of a conveyance system that drives an intermediate transfer belt according to an embodiment.

FIG. 3 is a diagram for explaining a configuration of a conveyance system that drives the intermediate transfer belt 421 according to an embodiment.

As illustrated in FIG. 3 and as described above, the intermediate transfer belt 421 is looped around the plurality of support rollers 423.

In this example, the driving roller 423B is driven by the driver 150. The driver 150 includes a motor electrically connected to the driving roller 423B, and the rotational output of the motor is transmitted to the driving roller 423B via a gear or the like fixed to the rotating shaft of the motor. The driver 150 may include any one of a brushless DC motor, a pulse motor, a DC motor with a brush, an ultrasonic motor, a direct drive motor, and the like. In the case of using an ultrasonic motor or a direct drive motor, owing to the characteristics of the motor, it is possible to directly drive the driving roller 423B without using a mechanism such as a gear. In this example, the speed of the driving roller 423B can be adjusted by controlling the motor. That is, it is possible to adjust the travel speed of the intermediate transfer belt 421.

Rotary encoders 425A and 425B are provided on the roller 423A and the driving roller 423B, respectively.

The rotary encoders 425A and 425B are connected to the shaft ends of the roller 423A and the driving roller 423B, respectively.

In an embodiment, pieces of rotation information of the roller 423A and the driving roller 423B are detected by the rotary encoders 425A and 425B, and the speed information of the intermediate transfer belt 421 is detected from each of the pieces of rotation information.

In this example, a method with contact rotary encoders is used as a method of detecting speed information, but the speed information of the intermediate transfer belt 421 can also be detected using a non-contact laser Doppler meter or optical sensor.

<Functional Block Configuration>

Figure 4:
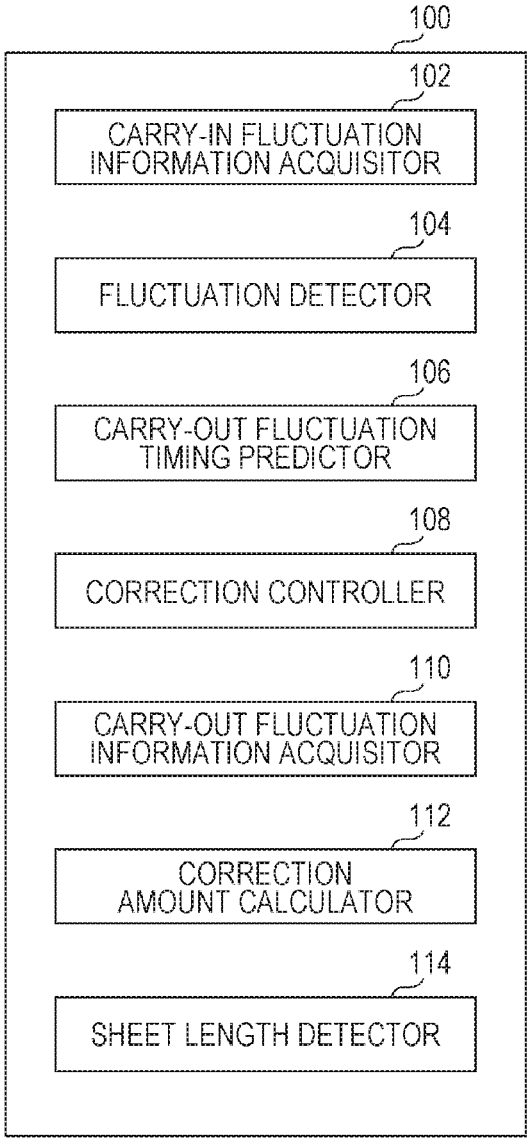
FIG. 4 is a diagram for explaining functional blocks of a controller of the image forming apparatus according to an embodiment.

FIG. 4 is a diagram for explaining functional blocks of the controller 100 of the image forming apparatus 1 according to an embodiment.

As illustrated in FIG. 4, the controller 100 includes a carry-in fluctuation information acquisitor 102, a fluctuation detector 104, a carry-out fluctuation timing predictor 106, a correction controller 108, a carry-out fluctuation information acquisitor 110, a correction amount calculator 112, and a sheet length detector 114.

Each functional block is realized by the CPU 101 reading a program stored in the ROM 105 and developing it in the RAM 103. It should be noted that the program need not necessarily be stored in the ROM 105 but may be stored in the storage section 72 or may be downloaded via the communication section 71 as necessary.

The carry-in fluctuation information acquisitor 102 acquires carry-in fluctuation information of the speed fluctuation of the intermediate transfer belt 421 when the sheet S (sheet member) is carried into the intermediate transfer belt 421.

In this example, the carry-in fluctuation information acquisitor 102 acquires the carry-in fluctuation information of the speed fluctuation of the intermediate transfer belt 421 when the sheet S is carried into the intermediate transfer belt 421 based on the rotation information from the rotary encoder 425A provided on the roller 423A.

Specifically, the carry-in fluctuation information acquisitor 102 acquires the speed fluctuation of the driving roller 423B by acquiring the speed fluctuation of the intermediate transfer belt 421.

Based on the carry-in fluctuation information acquired by the carry-in fluctuation information acquisitor 102, the fluctuation detector 104 detects the carry-in fluctuation timing of the speed fluctuation of the intermediate transfer belt 421 that occurs when the sheet S (sheet member) is carried into the intermediate transfer belt 421. Specifically, the carry-in fluctuation information acquisitor 102 acquires the carry-in fluctuation timing of the speed fluctuation of the driving roller 423B by acquiring the speed fluctuation of the intermediate transfer belt 421.

The carry-out fluctuation timing predictor 106 predicts the carry-out fluctuation timing of the speed fluctuation of the intermediate transfer belt 421 that occurs when the sheet S (sheet member) is carried from the intermediate transfer belt 421 based on the carry-in fluctuation timing detected by the fluctuation detector 104. Specifically, the carry-out fluctuation timing predictor 106 predicts the carry-out fluctuation timing of the speed fluctuation of the driving roller 423B.

The correction controller 108 performs feedforward control on the driver 150 based on the carry-out fluctuation timing predicted by the carry-out fluctuation timing predictor 106, so that the speed fluctuation that occurs when the sheet S (sheet member) is carried from the intermediate transfer belt 421 is corrected. Specifically, the correction controller 108 outputs an instruction to the driver 150 according to the correction amount calculated by the correction amount calculator 112. The driver 150 controls the rotation of the driving roller 423B according to the instruction from the correction controller 108.

The carry-out fluctuation information acquisitor 110 acquires carry-out fluctuation information of the speed fluctuation when the sheet S (sheet member) is carried from the intermediate transfer belt 421.

Based on the rotation information from the rotary encoder 425B provided on the driving roller 423B, the carry-out fluctuation information acquisitor 110 acquires the carry-out fluctuation information of the speed fluctuation of the driving roller 423B when the sheet S is carried from the intermediate transfer belt 421.

The correction amount calculator 112 calculates, based on the carry-out fluctuation information, the correction amount for performing the feedforward control in the correction controller 108.

The sheet length detector 114 is provided on the upstream side of the intermediate transfer belt 421 in the conveyance direction of the sheet S (sheet member), and detects the length of the sheet S (sheet member). The sheet length detector 114 detects the length of the sheet S according to the detection signal of the detection sensor 55.

<Information on Speed Fluctuation>

Figure 5A:
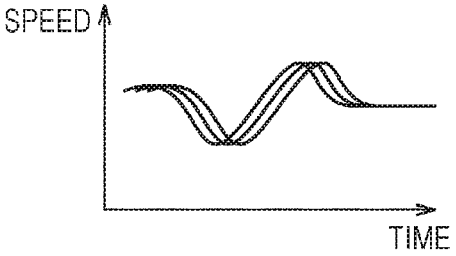
FIG. 5A and FIG. 5B are diagrams for explaining speed fluctuation according to an embodiment.
Figure 5B:
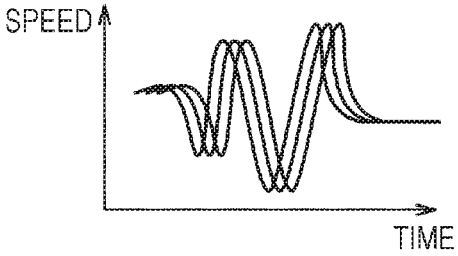

FIG. 5A and FIG. 5B are diagrams for explaining speed fluctuation according to an embodiment.

FIG. 5A indicates the speed fluctuation of the driving roller 423B that occurs when the sheet S is carried into the intermediate transfer belt 421.

FIG. 5B indicates the speed fluctuation of the driving roller 423B that occurs when the sheet S is carried from the intermediate transfer belt 421.

As illustrated in the drawings, the range of the speed fluctuation of the driving roller 423B is larger when the sheet S is carried from the intermediate transfer belt 421.

Therefore, the speed fluctuation of the driving roller 423B that occurs when the sheet S is carried from the intermediate transfer belt 421 is more likely to cause density unevenness.

In an embodiment, a method of mainly suppressing the speed fluctuation of the driving roller 423B that occurs when the sheet S is carried from the intermediate transfer belt 421 will be described.

<Feedforward Control>

Figure 6:
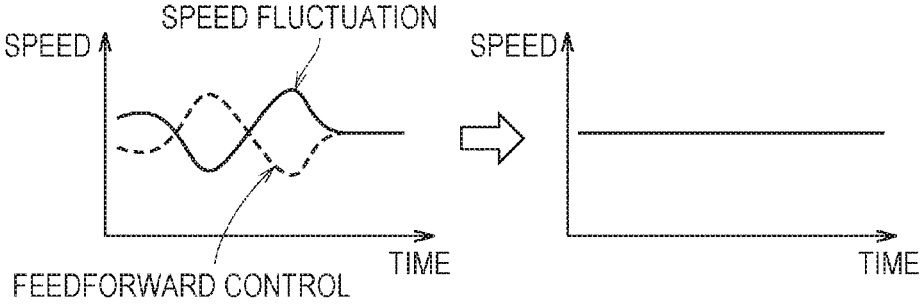
FIG. 6 is a diagram for explaining the concept of feedforward control according to an embodiment.

FIG. 6 is a diagram for explaining the concept of feedforward control according to an embodiment.

As illustrated in FIG. 6, in this example, when it is known in advance that the speed fluctuation occurs, the speed fluctuation is corrected by the feedforward control. Specifically, the speed of the intermediate transfer belt 421 is adjusted so as to have the reverse phase of the waveform of the speed fluctuation. Specifically, the speed of the driving roller 423B is adjusted. It is possible to keep the speed of the intermediate transfer belt 421 constant by the feedforward control.

Figure 7:
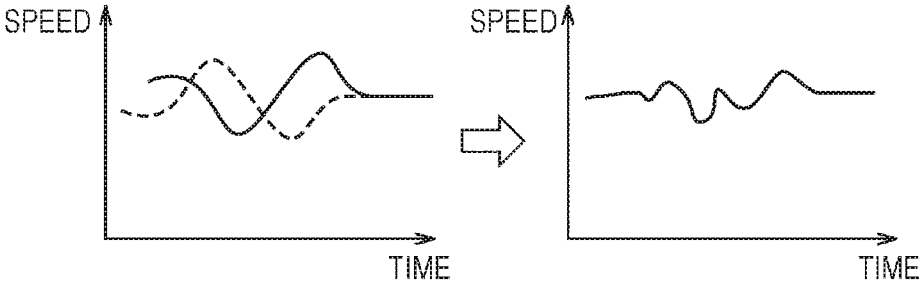
FIG. 7 is a diagram for explaining the concept of feedforward control according to Comparative Example.

FIG. 7 is a diagram for explaining the concept of feedforward control according to Comparative Example.

As illustrated in FIG. 7, when speed fluctuation is corrected by feedforward control, the speed of the driving roller 423B is adjusted so as to have the reverse phase of the waveform of the speed fluctuation. However, if the timing is missed, it is difficult to keep the speed of the driving roller 423B constant.

Therefore, it is important to adjust the timing of feedforward control.

<Calculation of Correction Amount>

Figure 8:
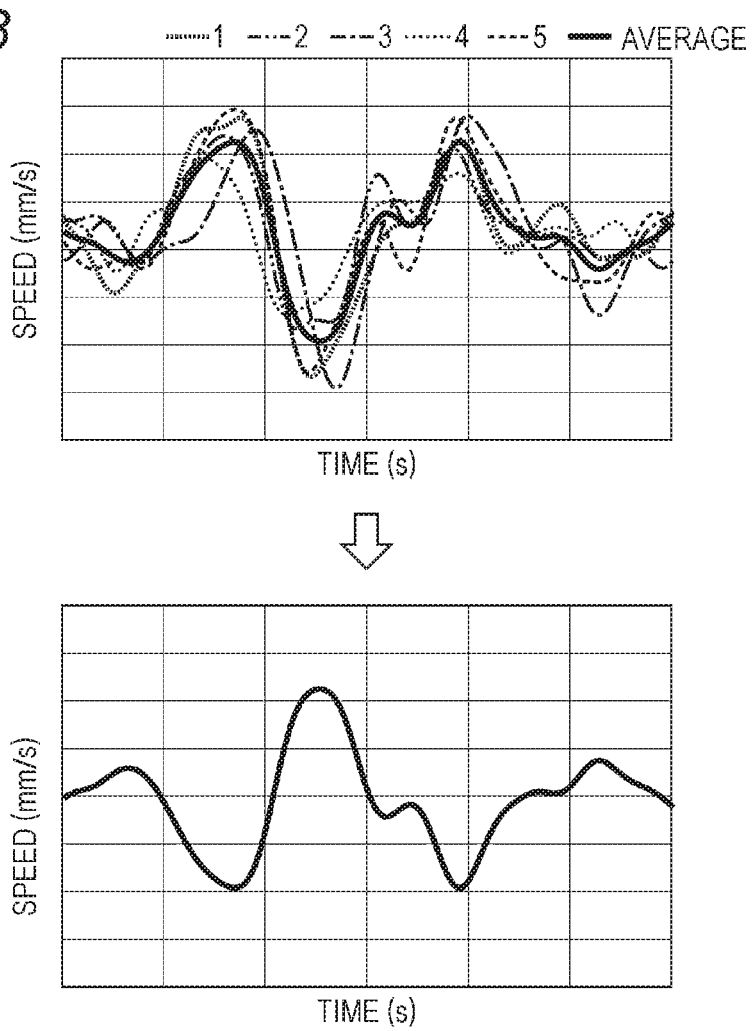
FIG. 8 is a diagram for explaining calculation of a correction amount for feedforward control according to an embodiment.

FIG. 8 is a diagram for explaining calculation of a correction amount for feedforward control according to an embodiment.

FIG. 8 indicates sample waveforms of the speed fluctuation of the driving roller 423B that occurs when sheets S are carried from the intermediate transfer belt 421.

The carry-out fluctuation information acquisitor 110 acquires the carry-out fluctuation information of the speed fluctuation of the driving roller 423B when the sheet S is carried from the intermediate transfer belt 421. In the illustrated example, the measurement is performed five times.

The correction amount calculator 112 calculates the correction amount for the feedforward control based on the multiple pieces of carry-out fluctuation information acquired. Specifically, the correction amount calculator 112 calculates the waveform of the reverse phase of the average value (average waveform) of the measured waveforms as a correction waveform (correction amount).

<Timing Prediction>

In an embodiment, the timing of executing the feedforward control is predicted.

Figure 9:
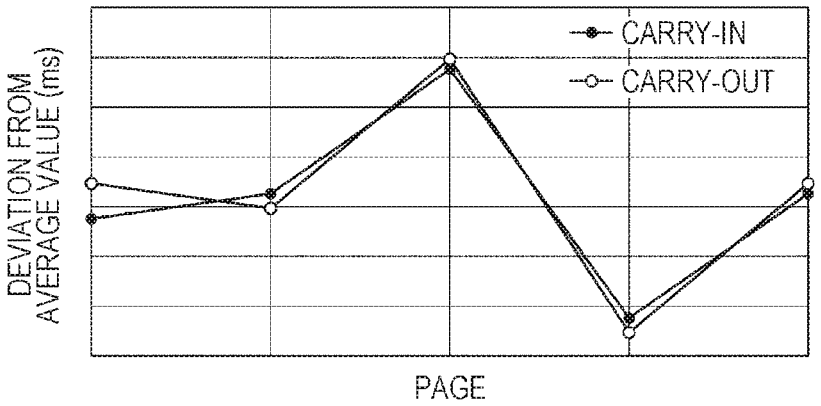
FIG. 9 is a diagram for explaining the deviation of the peak value of the speed fluctuation of a driving roller in association with each sheet, according to an embodiment.

FIG. 9 is a diagram for explaining the deviation of the peak value of the speed fluctuation of the driving roller 423B in association with each sheet, according to an embodiment.

As illustrated in FIG. 9, there is a correlation between the time deviation of the peak value of the speed fluctuation of the driving roller 423B that occurs when the sheet S is carried into the intermediate transfer belt 421 and the time deviation of the peak value of the speed fluctuation of the driving roller 423B that occurs when the sheet S is carried from the intermediate transfer belt 421. That is, the period between the peak value of the speed fluctuation of the driving roller 423B that occurs when the sheet S is carried into the intermediate transfer belt 421 and the peak value of the speed fluctuation of the driving roller 423B that occurs when the sheet S is carried from the intermediate transfer belt 421 is substantially constant.

Therefore, if the speed fluctuation of the driving roller 423B that occurs when the sheet S is carried into the intermediate transfer belt 421 is detected, it is possible to predict the timing of the speed fluctuation of the driving roller 423B that occurs when the sheet S is carried from the intermediate transfer belt 421 since the period is constant.

That is, in an embodiment, the timing (carry-in fluctuation timing) of the speed fluctuation of the driving roller 423B that occurs when the sheet S is carried into the intermediate transfer belt 421 is detected, and the timing (carry-out fluctuation timing) of the speed fluctuation of the driving roller 423B that occurs when the sheet S is carried from the intermediate transfer belt 421 is predicted based on the carry-in fluctuation timing.

<Specific Method of Feedforward Control>

Figure 10:
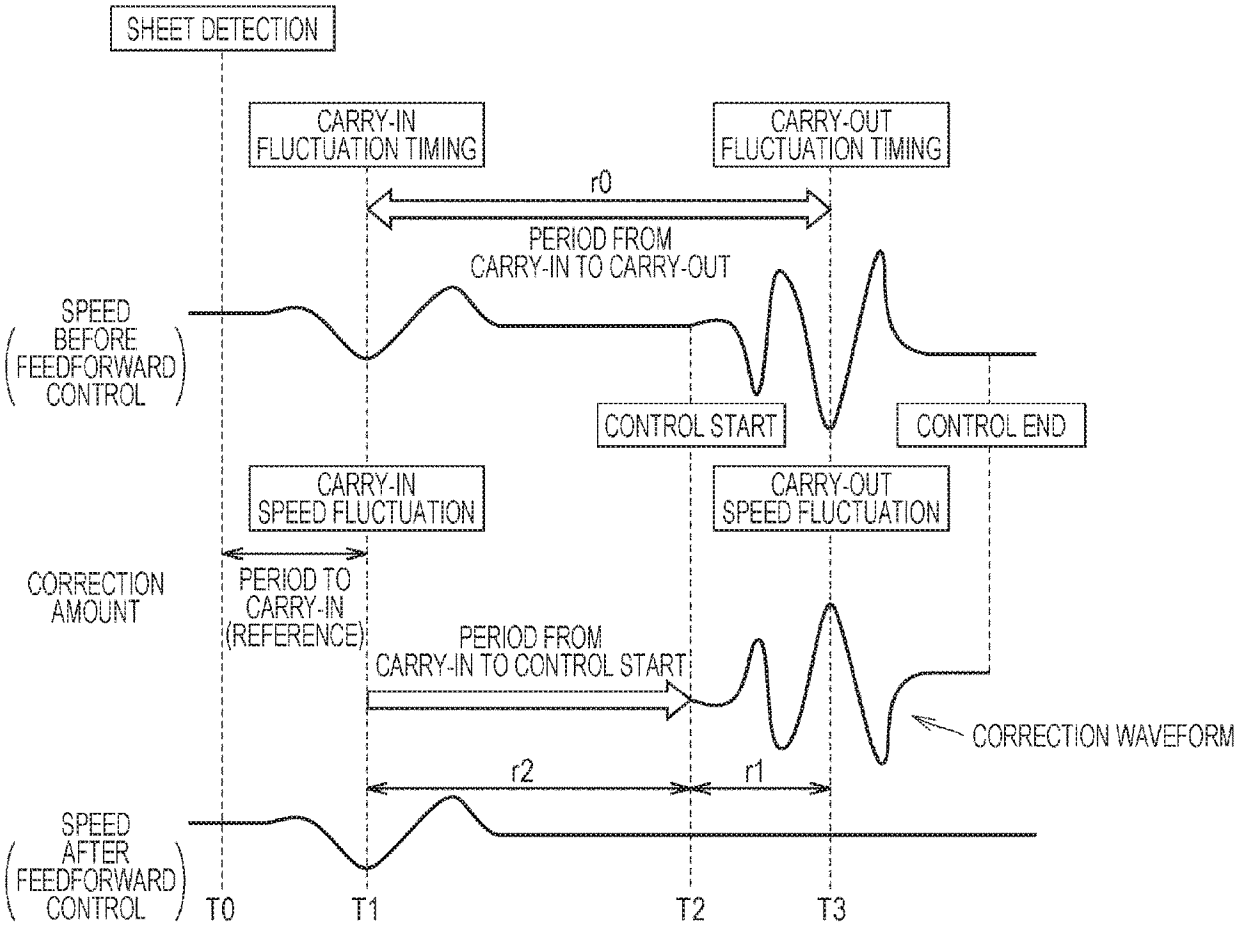
FIG. 10 is a diagram for explaining the preparation before executing the feedforward control according to an embodiment.

FIG. 10 is a diagram for explaining the preparation before executing the feedforward control according to an embodiment.

FIG. 10 indicates the speed fluctuation of the driving roller 423B that occurs after the detection sensor 55 detects the sheet S at the time T0.

First, speed fluctuation occurs when the sheet S is first carried into the intermediate transfer belt 421.

Then, speed fluctuation occurs when the sheet S is carried from the intermediate transfer belt 421.

In this example, the timing of the peak value of the speed fluctuation of the driving roller 423B that occurs when the sheet S is carried into the intermediate transfer belt 421 at the time T1 is regarded as the carry-in fluctuation timing.

Further, the timing of the peak value of the speed fluctuation of the driving roller 423B that occurs when the sheet S is carried from the intermediate transfer belt 421 at the time T3 is regarded as the carry-out fluctuation timing.

As described above, the period between the carry-in fluctuation timing and the carry-out fluctuation timing is a constant period, that is, a predetermined period.

Therefore, the peak value of the correction waveform (correction amount) is set at the carry-out fluctuation timing.

By this setting, the start time T2 of the feedforward control is set.

Specifically, assuming that the period between the carry-in fluctuation timing and the carry-out fluctuation timing is the period r0 and the period to the peak value of the correction waveform is the period r1, the period r2 from the carry-in fluctuation timing to the control start can be calculated using r0−r1.

The carry-out fluctuation timing predictor 106 can set the time after the lapse of the period r2 from the time T1 as the start time T2 of the feedforward control.

Next, a method of detecting the timing of speed fluctuation (carry-in fluctuation timing) when the sheet S is carried into the intermediate transfer belt 421 will be described.

In this example, the carry-in fluctuation information acquisitor 102 acquires in advance a reference waveform of the carry-in speed fluctuation that serves as a reference for the carry-in fluctuation information.

The fluctuation detector 104 compares the previously acquired reference waveform with the carry-in fluctuation information (carry-in fluctuation waveform) currently acquired by the carry-in fluctuation information acquisitor 102 to calculate a correlation value.

The fluctuation detector 104 calculates a position (period) with the highest correlation value with the reference waveform by shifting the currently acquired carry-in fluctuation information (carry-in fluctuation waveform). The shifted amount is referred to as a deviation amount.

Figure 11:
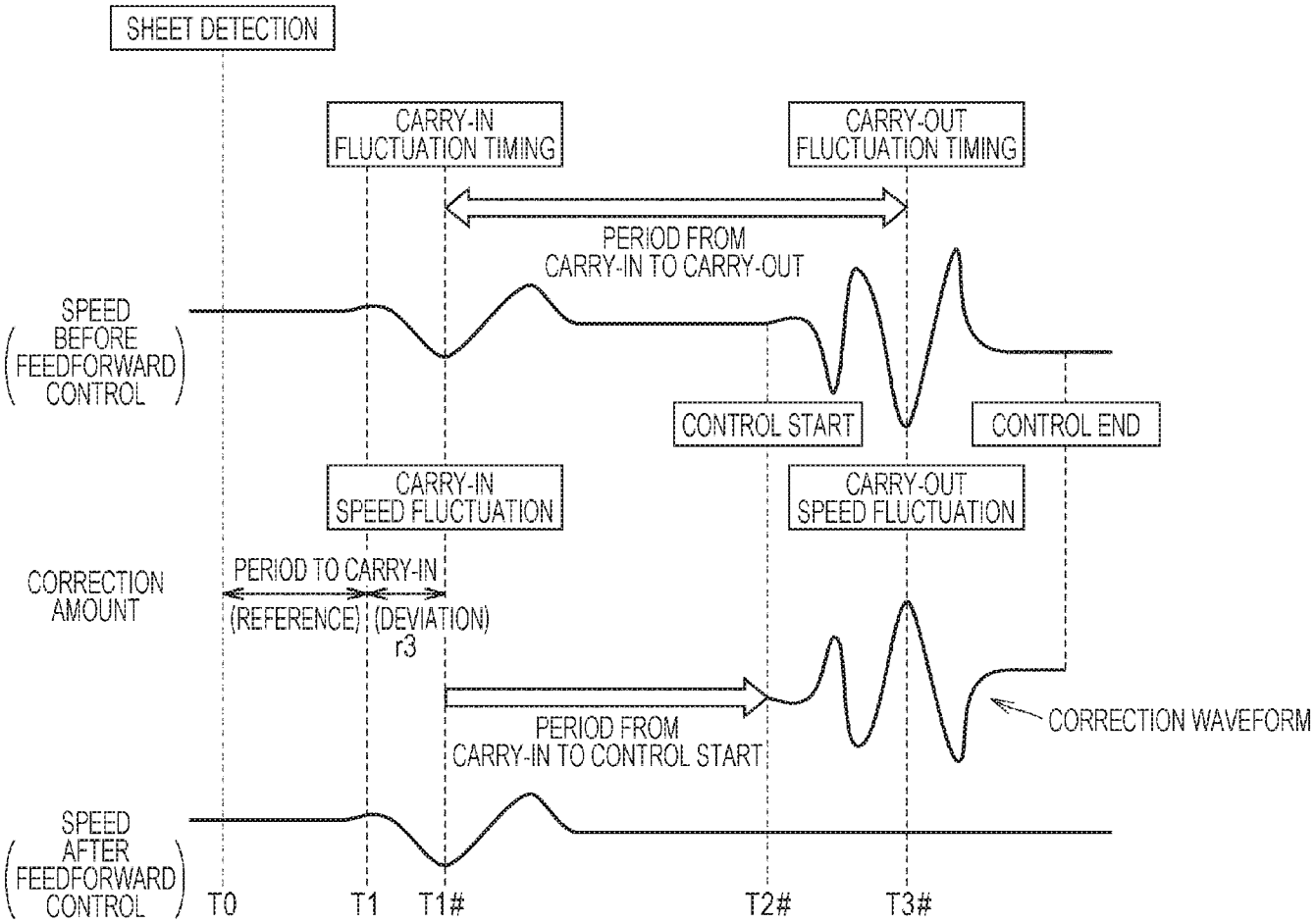
FIG. 11 is a diagram for explaining a specific method of feedforward control according to an embodiment.

FIG. 11 is a diagram for explaining a specific method of feedforward control according to an embodiment.

FIG. 11 indicates the speed fluctuation of the driving roller 423B that occurs after the detection sensor 55 detects the sheet S at the time T0.

Here, the deviation amount r3 from the reference waveform is illustrated. That is, the time T1# after the lapse of the deviation amount r3 from the time T0 is detected as the carry-in fluctuation timing.

As a result, the carry-out fluctuation timing is predicted to be the time T3# after the lapse of the period r2 from the time T1#.

Further, according to the above method, the carry-out fluctuation timing predictor 106 sets the time after the lapse of the period r2 from the time T1# as the start time T2# of the feedforward control.

<Simulation Results>

Figure 12:
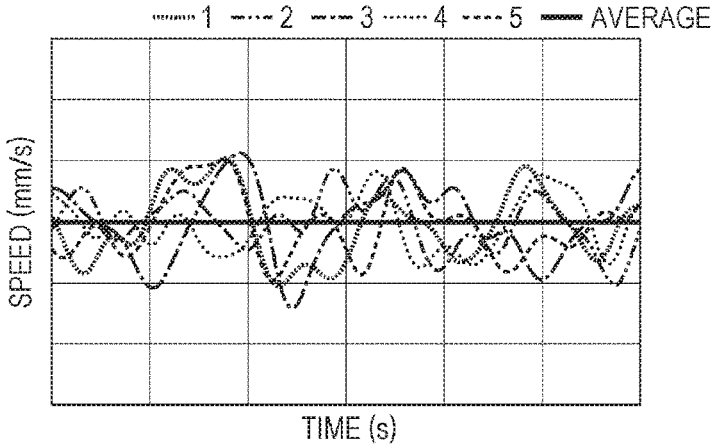
FIG. 12 is a diagram for explaining the speed fluctuation that occurs when sheets are carried from the intermediate transfer belt in a case where the feedforward control according to an embodiment is executed.

FIG. 12 is a diagram for explaining the speed fluctuation that occurs when sheets S are carried from the intermediate transfer belt 421 in a case where the feedforward control according to an embodiment is executed.

FIG. 12 indicates that the speed fluctuation is greatly reduced compared with the speed fluctuation represented by the waveforms of FIG. 8.

Figure 13:
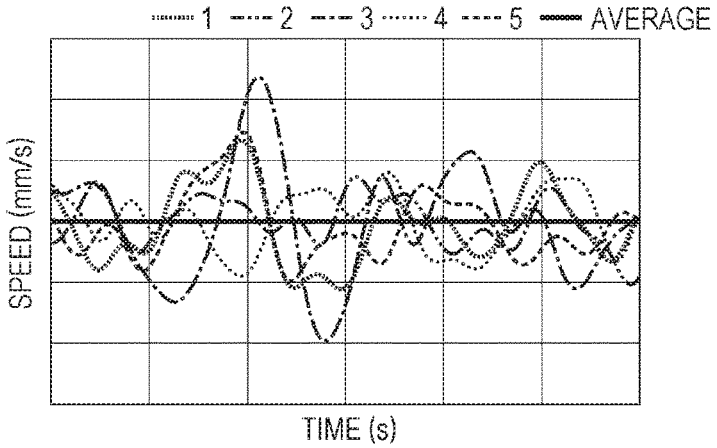
FIG. 13 is a diagram for explaining the speed fluctuation that occurs when sheets are carried from the intermediate transfer belt in a case where the feedforward control is executed without considering the deviation amount with reference to the reference waveform, according to Comparative Example.

FIG. 13 is a diagram for explaining the speed fluctuation that occurs when sheets S are carried from the intermediate transfer belt 421 in a case where the feedforward control is executed without considering the deviation amount with reference to the reference waveform, according to Comparative Example.

FIG. 13 indicates that the speed fluctuation represented by the waveforms tends to be reduced more in this case than in the case of FIG. 8, but sufficient reduction effects cannot be obtained for some waveforms.

The effectiveness of the above embodiments could be confirmed from the above simulation results. That is, it is possible to effectively improve density unevenness.

In the above-described method, the fluctuation detector 104 according to the above embodiments compares the previously acquired reference waveform with the carry-in fluctuation information (carry-in fluctuation waveform) currently acquired by the carry-in fluctuation information acquisitor 102 to calculate the correlation value, and calculates the deviation amount based on the correlation value. However, the method of calculating the deviation amount is not limited to this method, and the deviation amount may be calculated using another method.

Specifically, the difference between the time of the peak value of the reference waveform and the time of the peak value of the carry-in fluctuation information (carry-in fluctuation waveform) currently acquired by the carry-in fluctuation information acquisitor 102 may be calculated as the deviation amount. Alternatively, the deviation amount may be calculated by comparing the times exceeding a predetermined threshold value (upper limit value or lower limit value), instead of comparing the times of the peak values.

Further, the above-described predetermined period between the carry-in fluctuation timing and the carry-out fluctuation timing varies depending on the type of sheet. Specifically, the characteristics vary depending on size, basis weight, thickness, and the like.

Therefore, the carry-out fluctuation timing predictor 106 calculates in advance predetermined periods between the carry-in fluctuation timing and the carry-out fluctuation timing in association with the respective types of sheets, and stores the information in the storage section 72. Then, the carry-out fluctuation timing predictor 106 acquires, from the storage section 72, the previously calculated predetermined period corresponding to the type of sheet with respect to the carry-in fluctuation timing detected by the fluctuation detector 104, and uses the acquired predetermined period to predict the carry-in fluctuation timing. This also enables the carry-out fluctuation timing predictor 106 to set the start time of the feedforward control in association with each type of sheet.

Thus, it is possible to execute appropriate feedforward control according to the type of sheet, and it is possible to effectively improve density unevenness.

Further, the above-described correction waveform (correction amount) may also be changed according to the type of sheet.

Figure 14:
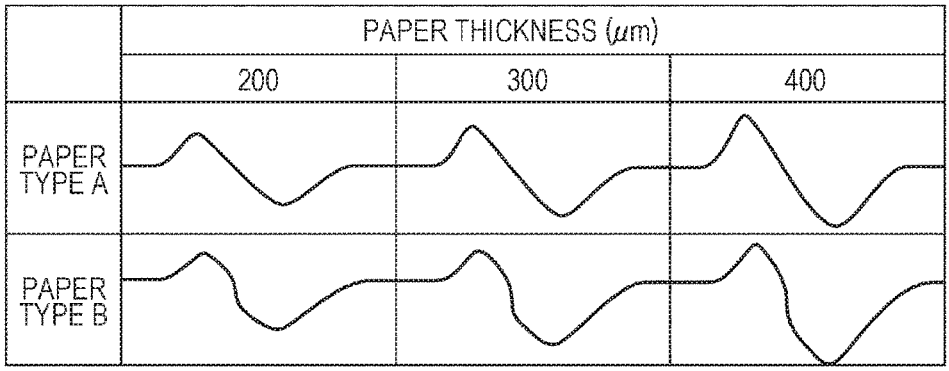
FIG. 14 is a diagram for explaining correction waveforms (correction amounts) according to an embodiment.

FIG. 14 is a diagram for explaining correction waveforms (correction amounts) according to an embodiment.

FIG. 14 indicates that six patterns of correction waveforms (correction amounts) are provided as a table based on paper types A and B and paper thickness.

Specifically, the carry-out fluctuation information acquisitor 110 acquires in advance the speed fluctuation that occurs when each type of sheet is carried from the intermediate transfer belt 421. For example, the measurement may be performed multiple times as described with reference to FIG. 8.

Then, the correction amount calculator 112 calculates, based on the pieces of carry-out fluctuation information acquired in association with the respective types of sheets, correction amounts for performing the feedforward control in the correction controller 108. Then, as illustrated in FIG. 14, the correction amounts are stored as a table in the storage section 72.

The correction controller 108 uses the table of FIG. 14 stored in the storage section 72 to acquire the correction amount corresponding to each type of sheet.

Then, based on the carry-out fluctuation timing predicted by the carry-out fluctuation timing predictor 106, the feedforward control is executed on the driver 150. With this method, it is possible to execute the feedforward control according to the type of sheet using the correction amount corresponding to each sheet, and it is possible to effectively improve density unevenness.

Further, the correction waveform (correction amount) may be modified by the automatic learning function.

Specifically, the carry-out fluctuation information acquisitor 110 may acquire the speed fluctuation that occurs when a sheet is carried from the intermediate transfer belt 421, and adjust the correction waveform (correction amount) if the carry-out fluctuation information acquisitor 110 determines that the speed fluctuation of the carry-out fluctuation information (carry-out fluctuation waveform) exceeds a predetermined threshold value.

For example, the carry-out fluctuation information acquisitor 110 may acquire multiple pieces of carry-out fluctuation information (carry-out fluctuation waveforms) in the case of executing the feedforward control to calculate the average waveform (average value) of the acquired pieces of carry-out fluctuation information (carry-out fluctuation waveforms), and may utilize, as the correction waveform (correction amount), a combined waveform obtained by combining the calculated average waveform (average value) and the previously utilized correction waveform (correction amount).

Further, the above-described predetermined period between the carry-in fluctuation timing and the carry-out fluctuation timing may be adjusted.

Specifically, the carry-out fluctuation information acquisitor 110 may acquire the speed fluctuation that occurs when a sheet is carried from the intermediate transfer belt 421, and adjust the predetermined period for use in the prediction if the carry-out fluctuation information acquisitor 110 determines that the speed fluctuation of the carry-out fluctuation information (carry-out fluctuation waveform) exceeds a predetermined threshold value.

For example, the carry-out fluctuation information acquisitor 110 may acquire multiple pieces of carry-out fluctuation information (carry-out fluctuation waveforms) in the case of executing the feedforward control to calculate the average waveform (average value) of the acquired pieces of carry-out fluctuation information (carry-out fluctuation waveforms), and may compare the calculated average waveform (average value) with the previously utilized correction waveform (correction amount) to adjust the predetermined period based on the comparison result. For example, the predetermined period may be shortened if the timing of the peak value of the average waveform exceeding a predetermined threshold value is earlier than the start of the utilized correction waveform, and the predetermined period may be lengthened if the timing of the peak value of the average waveform exceeding the predetermined threshold value is later than the start of the utilized correction waveform.

In addition, it is also conceivable that sheets of the same type have different sheet lengths. In such a case, highly precise feedforward control may be executed using the detection sensor 55 that detects the sheet S. The sheet length detector 114 detects the sheet length based on the detection result of the detection sensor 55.

Specifically, the carry-out fluctuation timing predictor 106 predicts the carry-out fluctuation timing of the speed fluctuation of the driving roller 423B that occurs when the sheet S is carried from the intermediate transfer belt 421 based on the detection result of the sheet length detector 114 and the carry-in fluctuation timing detected by the fluctuation detector 104. For example, while the sheet S passes through the detection sensor 55, the sheet length is detected, and if it is detected that the sheet length is longer than the set sheet length, the carry-out timing is delayed. Therefore, the above-described predetermined period may be adjusted (prolonged) for the prediction of the carry-out fluctuation timing. Alternatively, if it is detected that the sheet length is shorter than the set sheet length, the carry-out timing is shortened. Therefore, the above-described predetermined period may be adjusted (shortened) for the prediction of the carry-out fluctuation timing.

In the method described in this example, the driver 150 drives the driving roller 423B to adjust the speed fluctuation of the driving roller 423B that occurs when the sheet S is carried from the intermediate transfer belt 421. However, in a case where the driver 150 drives the roller 423A instead of the driving roller 423B, the speed fluctuation of the rotation speed of the roller 423A may be adjusted.

When the sheet S is carried into and from the intermediate transfer belt 421, not only the speed fluctuation of the intermediate transfer belt 421 but also the rotation speed of the photosensitive drum 413 and/or the secondary transfer roller 424 which are in direct or indirect contact with the intermediate transfer belt 421 is liable to be similarly affected.

Therefore, instead of the speed fluctuation of the intermediate transfer belt 421, the speed fluctuation of the photosensitive drum 413 and/or the secondary transfer roller 424 may be corrected.

Specifically, a rotary encoder for detecting the speed information of the photosensitive drum 413 may be provided to adjust the speed fluctuation of the photosensitive drum 413. For example, by using the rotary encoder provided on the photosensitive drum 413, carry-in fluctuation information of the speed fluctuation of the photosensitive drum 413 is acquired when the sheet S is carried into the intermediate transfer belt 421. Based on the acquired carry-in fluctuation information, the carry-in fluctuation timing of the speed fluctuation of the photosensitive drum 413 that occurs when the sheet S is carried into the intermediate transfer belt 421 is detected. Based on the detected carry-in fluctuation timing, the carry-out fluctuation timing of the speed fluctuation of the photosensitive drum 413 that occurs when the sheet S is carried from the intermediate transfer belt 421 is predicted. The driver 150 performs feedforward control on the driving motor that drives the photosensitive drum 413 based on the predicted carry-out fluctuation timing, thereby correcting the speed fluctuation that occurs when the sheet S is carried from the intermediate transfer belt.

Similarly, a rotary encoder for detecting the speed information of the secondary transfer roller 424 may be provided to correct the speed fluctuation of the secondary transfer roller 424.

Specifically, the rotary encoder for detecting the speed information of the secondary transfer roller 424 may be provided to adjust the speed fluctuation of the secondary transfer roller 424. For example, by using the rotary encoder provided on the secondary transfer roller 424, carry-in fluctuation information of the speed fluctuation of the secondary transfer roller 424 is acquired when the sheet S is carried into the intermediate transfer belt 421. Based on the acquired carry-in fluctuation information, the carry-in fluctuation timing of the speed fluctuation of the secondary transfer roller 424 that occurs when the sheet S is carried into the intermediate transfer belt 421 is detected. Based on the detected carry-in fluctuation timing, the carry-out fluctuation timing of the speed fluctuation of the secondary transfer roller 424 that occurs when the sheet S is carried from the intermediate transfer belt 421 is predicted. The driver 150 performs feedforward control on the driving motor that drives the secondary transfer roller 424 based on the predicted carry-out fluctuation timing, thereby correcting the speed fluctuation that occurs when the sheet S is carried from the intermediate transfer belt.

It is also possible to arbitrarily combine the correction of the speed fluctuation of the photosensitive drum 413 and the secondary transfer roller 424 with the correction of the speed fluctuation of the driving roller 423B.

Although embodiments of the present invention have been described and illustrated in detail, the disclosed embodiments are made for purposes of illustration and example only and not limitation. The scope of the present invention should be interpreted by terms of the appended claims. The scope of the present invention is intended that all modifications within the meaning and scope equivalent to the scope of claims are included.

What is claimed is:

1. An image forming apparatus comprising:

a photosensitive drum;

a driving roller that drives a transfer member for transferring an image carried by the photosensitive drum;

a facing roller facing the driving roller;

a driver that drives at least one of the photosensitive drum, the driving roller, and the facing roller; and a hardware processor that:

acquires carry-in fluctuation information of speed fluctuation of at least any one of the photosensitive drum, the driving roller, and the facing roller when a sheet member is carried into the transfer member;

based on the carry-in fluctuation information acquired, detects carry-in fluctuation timing of the speed fluctuation of at least any one of the photosensitive drum, the driving roller, and the facing roller that occurs when the sheet member is carried into the transfer member;

based on the carry-in fluctuation timing detected, predicts carry-out fluctuation timing of speed fluctuation of at least any one of the photosensitive drum, the driving roller, and the facing roller that occurs when the sheet member is carried from the transfer member; and based on the carry-out fluctuation timing predicted, performs feedforward control on the driver to correct the speed fluctuation that occurs when the sheet member is carried from the transfer member.

2. The image forming apparatus according to claim 1, wherein the hardware processor detects the carry-in fluctuation timing of the speed fluctuation of at least any one of the photosensitive drum, the driving roller, and the facing roller if it is determined, based on the carry-in fluctuation information acquired, that the speed fluctuation exceeds a predetermined threshold value.

3. The image forming apparatus according to claim 1, wherein the hardware processor calculates a correlation value between a waveform of the carry-in fluctuation information acquired and a reference waveform, and detects the carry-in fluctuation timing of the speed fluctuation of at least any one of the photosensitive drum, the driving roller, and the facing roller based on a calculation result.

4. The image forming apparatus according to claim 1, wherein the hardware processor calculates in advance a predetermined period between carry-in fluctuation timing of speed fluctuation of at least any one of the photosensitive drum, the driving roller, and the facing roller that occurs when the sheet member is carried into the transfer member and carry-out fluctuation timing of speed fluctuation of at least any one of the photosensitive drum, the driving roller, and the facing roller that occurs when the sheet member is carried from the transfer member, and predicts, with respect to the carry-in fluctuation timing detected, the carry-out fluctuation timing according to the predetermined period calculated.

5. The image forming apparatus according to claim 4, wherein a plurality of types of the sheet members is provided, and the hardware processor calculates in advance, in association with the respective types, a plurality of predetermined periods between carry-in fluctuation timing of speed fluctuation of at least any one of the photosensitive drum, the driving roller, and the facing roller that occurs when the sheet members are carried into the transfer member and carry-out fluctuation timing of speed fluctuation of at least any one of the photosensitive drum, the driving roller, and the facing roller that occurs when the sheet members are carried from the transfer member, and predicts, with respect to the carry-in fluctuation timing detected, the carry-out fluctuation timing according to one of the predetermined periods calculated in association with the types of the sheet members.

6. The image forming apparatus according to claim 1, wherein the hardware processor further acquires carry-out fluctuation information of speed fluctuation of at least any one of the photosensitive drum, the driving roller, and the facing roller when the sheet member is carried from the transfer member, and calculates a correction amount for performing the feedforward control based on the carry-out fluctuation information.

7. The image forming apparatus according to claim 6, wherein a plurality of types of the sheet members is provided, and the hardware processor acquires, in association with the respective types, pieces of carry-out fluctuation information of speed fluctuation of at least any one of the photosensitive drum, the driving roller, and the facing roller when the sheet member is carried from the transfer member, calculates a plurality of correction amounts for performing the feedforward control based on the pieces of carry-out fluctuation information corresponding to the respective types, and according to the correction amounts corresponding to the respective types and based on the carry-out fluctuation timing predicted, performs the feedforward control on the driver to correct the speed fluctuation that occurs when the sheet member is carried from the transfer member.

8. The image forming apparatus according to claim 6, wherein the hardware processor recalculates the correction amount for performing the feedforward control based on the carry-out fluctuation information if it is determined that the speed fluctuation of the carry-out fluctuation information exceeds a predetermined threshold value.

9. The image forming apparatus according to claim 1, wherein the hardware processor modifies prediction of the carry-out fluctuation timing based on the carry-out fluctuation information if it is determined that the speed fluctuation of the carry-out fluctuation information exceeds a predetermined threshold value.

10. The image forming apparatus according to claim 1, wherein the hardware processor further detects a length of the sheet member on an upstream side of the transfer member in a conveyance direction of the sheet member, and the hardware processor predicts the carry-out fluctuation timing of the speed fluctuation of at least any one of the photosensitive drum, the driving roller, and the facing roller that occurs when the sheet member is carried from the transfer member based on a result of detecting the length of the sheet and the carry-in fluctuation timing detected.

* * * * *